US005542136A

United States Patent [19]

Tappel

[11] Patent Number: 5,542,136

[45] Date of Patent: Aug. 6, 1996

[54] PORTABLE MATTRESS FOR TREATING DECUBITUS ULCERS

[75] Inventor: James G. Tappel, Hickory Corners, Mich.

[73] Assignee: Stryker Corporation, Kalamazoo, Mich.

[21] Appl. No.: 286,765

[22] Filed: Aug. 5, 1994

[51] Int. Cl.[6] ..... A61G 7/04

[52] U.S. Cl. ..... 5/710; 5/658; 5/914; 5/713; 5/738

[58] Field of Search ..... 5/453, 455, 456, 5/470, 480, 903, 914, 503.1, 658

[56] References Cited

U.S. PATENT DOCUMENTS

| | | | |
|---|---|---|---|
| 2,750,606 | 1/1956 | Freedlander et al. . | |
| 2,826,244 | 3/1958 | Hurley . | |
| 3,644,950 | 2/1972 | Lindsay, Jr. . | |
| 3,798,686 | 3/1974 | Gaiser . | |
| 4,189,798 | 2/1980 | Vessey . | |
| 4,394,784 | 7/1983 | Swenson et al. . | |
| 4,484,367 | 11/1984 | Jenkins | 5/503.1 X |
| 4,542,547 | 9/1985 | Sato . | |
| 4,680,790 | 7/1987 | Packard et al. | 5/658 |
| 4,686,722 | 8/1987 | Swart . | |
| 4,694,520 | 9/1987 | Paul et al. . | |
| 4,803,744 | 2/1989 | Peck et al. . | |
| 4,873,737 | 10/1989 | Savenije . | |
| 4,949,412 | 8/1990 | Goode . | |
| 4,977,633 | 12/1990 | Chaffee . | |
| 4,995,124 | 2/1991 | Wridge, Jr. et al. . | |
| 5,020,176 | 6/1991 | Dotson . | |
| 5,068,933 | 12/1991 | Sexton . | |
| 5,090,077 | 2/1992 | Caden et al. | 5/456 |
| 5,121,512 | 6/1992 | Kaufmann | 5/455 X |
| 5,235,713 | 8/1993 | Guthrie et al. . | |
| 5,243,721 | 9/1993 | Teasdale | 5/453 |
| 5,249,319 | 10/1993 | Higgs . | |
| 5,267,364 | 12/1993 | Volk | 5/470 X |
| 5,325,551 | 7/1994 | Tappel et al. | 5/453 |
| 5,373,595 | 12/1994 | Johnson et al. | 5/453 |
| 5,375,273 | 12/1994 | Bodinc, Jr. et al. | 5/914 X |

FOREIGN PATENT DOCUMENTS

| | | | |
|---|---|---|---|
| 1545806 | 5/1979 | United Kingdom | 5/455 |

*Primary Examiner*—Michael F. Trettel

*Attorney, Agent, or Firm*—Flynn, Thiel, Boutell & Tanis, P.C.

[57] ABSTRACT

A portable mattress system has a mattress unit, a control unit, and a control panel. The mattress unit has a plurality of sleeves with transverse openings which each receive an elongate bladder, and has in a foot section a recess that can receive the control unit. A coupling arrangement detachably operatively couples the control unit to the mattress unit. The control panel is flat and thin and is coupled to the control unit by a cable. An arrangement is provided to support the mattress unit on the control unit when the mattress unit is in a deflated condition, and the control unit has rotatable wheels and a handle for facilitating easy transport of the entire mattress system to or from a bed.

20 Claims, 7 Drawing Sheets

PORTABLE MATTRESS FOR TREATING DECUBITUS ULCERS

FIELD OF THE INVENTION

The present invention relates to a mattress system for treating or for avoiding development of decubitus ulcers and, more particularly, to such a mattress system having an inflatable bladder and a control unit for controlling a pressure within the bladder.

BACKGROUND OF THE INVENTION

Decubitus ulcers, commonly known as bedsores, typically develop when a patient is required to spend a relatively long period of time recuperating in bed with a minimal amount of movement. Various different types of beds and mattresses have been designed to avoid the development of decubitus ulcers and/or to treat decubitus ulcers which have already developed. One known type of system uses a mattress containing an inflatable bladder arrangement with a number of separate zones, and a control unit which separately controls the pressure in each zone. While units of this type have been generally adequate for their intended purposes, they have not been satisfactory in all respects.

First, at least where there are a plurality of zones, the mattress unit is often an integral part of an entire bed, as opposed to a separate component which can be moved from bed to bed. Further, the mattress unit can be relatively difficult to clean, in that all air bladders must be individually removed and laundered, and can be damaged if laundered at the wrong temperature or by the wrong procedure. Moreover, the procedure required to program the unit for the needs of a particular patient can be relatively complex. Those who do not program such systems on a regular basis must refer to an instruction manual, and even then may not achieve optimum settings for the particular circumstances.

As a result of these considerations, hospitals typically do not purchase mattresses/beds of this type. Instead, when a doctor prescribes use of such equipment, the hospital contacts a local rental company which brings over an entire bed, puts it in place, sets it up, and programs it for the particular patient. When the patient's need for the better mattress is completed, the rental company comes and takes it away, and does the necessary maintenance and cleaning. At a large hospital doing a reasonable rental volume of such beds, it is not unknown for a full-time employee of the rental company to have an office at the hospital itself. A further consideration is that the control unit for the mattress is a relatively large unit which either sits on the floor, making it difficult to transport the bed because the control unit must be separately moved with the bed, or is mounted on a footboard of the bed, giving the bed and the control unit a combined length longer than the interior dimensions of existing elevators in the hospital.

It is therefore an object of the present invention to provide an inflatable mattress system for avoiding or treating decubitus ulcers, which is easily transportable and does not include a bed as an integral part thereof.

It is a further object to provide such a mattress system which can be easily and quickly cleaned and sterilized by wiping the exterior with common antiseptics, and which can be easily and quickly set up and programmed without the use of a instruction manual and with little or no special training.

It is a further object to provide such a mattress system in which the mattress unit has a recess that receives the control unit, so that the control unit is within the overall envelope of the mattress shape, and in which a single simple connection arrangement is provided for operatively coupling the mattress unit and the control unit.

A further object is to provide such a mattress system having a separate small control panel which is flat and can be mounted on a footboard or side rail of the bed without interfering with maneuverability of the bed through hallways and elevators.

A further object of the invention is to provide such a mattress system in which the arrangement of keys and indicia on the control panel are substantially self-explanatory, to permit quick and accurate programming by a person who has limited training.

Still another object of the invention is to provide such a mattress system in which the control unit has wheels and a handle, and an arrangement is provided to support the control panel and the deflated mattress unit on the control unit for transport to or from a bed.

SUMMARY OF THE INVENTION

The objects and purposes of the invention, including those set forth above, are met according to one form of the invention by providing a portable patient support system which includes: a mattress unit having therein an inflatable bladder arrangement and having operational and collapsed states in which the bladder arrangement is respectively inflated and deflated, wherein the mattress has an exterior surface which includes an upwardly facing top surface portion in the operational state, has at one end a foot section, has in the foot section a portion of the bladder arrangement and has in the foot section below the portion of the bladder arrangement a recess which opens through the exterior surface of the mattress unit; a control unit having a size and shape permitting it to be removably received in its entirety within the recess; and an arrangement operatively coupling the control unit to the bladder arrangement within the mattress unit to facilitate control by the control unit of a pressure within the bladder arrangement.

According to a different form of the invention, a portable patient support system includes: a mattress unit having an inflatable bladder arrangement therein, and having operational and collapsed states in which the bladder arrangement is respectively inflated and deflated, wherein in the operational state the mattress unit has a downwardly facing bottom surface, the mattress unit having at one end thereof a foot section, and having in the foot section a recess which opens through the bottom surface; a control unit having a size and shape permitting it to be received in its entirety within the recess, the control unit having an arrangement for facilitating transport thereof in a non-operational state thereof, the arrangement for facilitating transport including wheels rotatably supported on the control unit; and an arrangement for operatively coupling the control unit to the bladder arrangement within the mattress unit to facilitate control by the control unit of a pressure within the bladder arrangement.

Still another form of the present invention involves an apparatus which includes: a mattress unit having an external cover made of a flexible material, a containment part provided within the cover and having therein a plurality of transverse horizontal openings, and a plurality of elongate inflatable bladders each removably disposed within a respective opening.

A different form of the invention involves a mattress system which includes: an inflatable bladder, a control unit which is operationally coupled to the inflatable bladder and which controls a pressure in the inflatable bladder as a function of a plurality of control parameters, and a control panel which is physically separate from and operationally coupled to the control unit and which facilitates manual setting of the control parameters, the control panel being a self-contained unit of flat and thin shape having manually operable keys on one side thereof, and having an arrangement thereon facilitating a removable support of the control panel on a bed.

Yet another form of the present invention involves a mattress system which includes: an inflatable bladder arrangement, a control unit which is operationally coupled to the bladder arrangement and which controls a pressure therein as a function of a plurality of control parameters, and a control panel which is operationally coupled to the control unit and which facilitates manual setting of the control parameters, wherein the control panel includes a plurality of regions which each have at least one manually operable key for adjusting a respective control parameter and which have respective sequencing indicia therein that indicate a sequence for adjustment of the control parameters through operation of the manually operable keys.

BRIEF DESCRIPTION OF THE DRAWINGS

A preferred embodiment of the present invention is described in detail hereinafter with reference to the accompanying drawings, in which.

DETAILED DESCRIPTION

Figure 1:
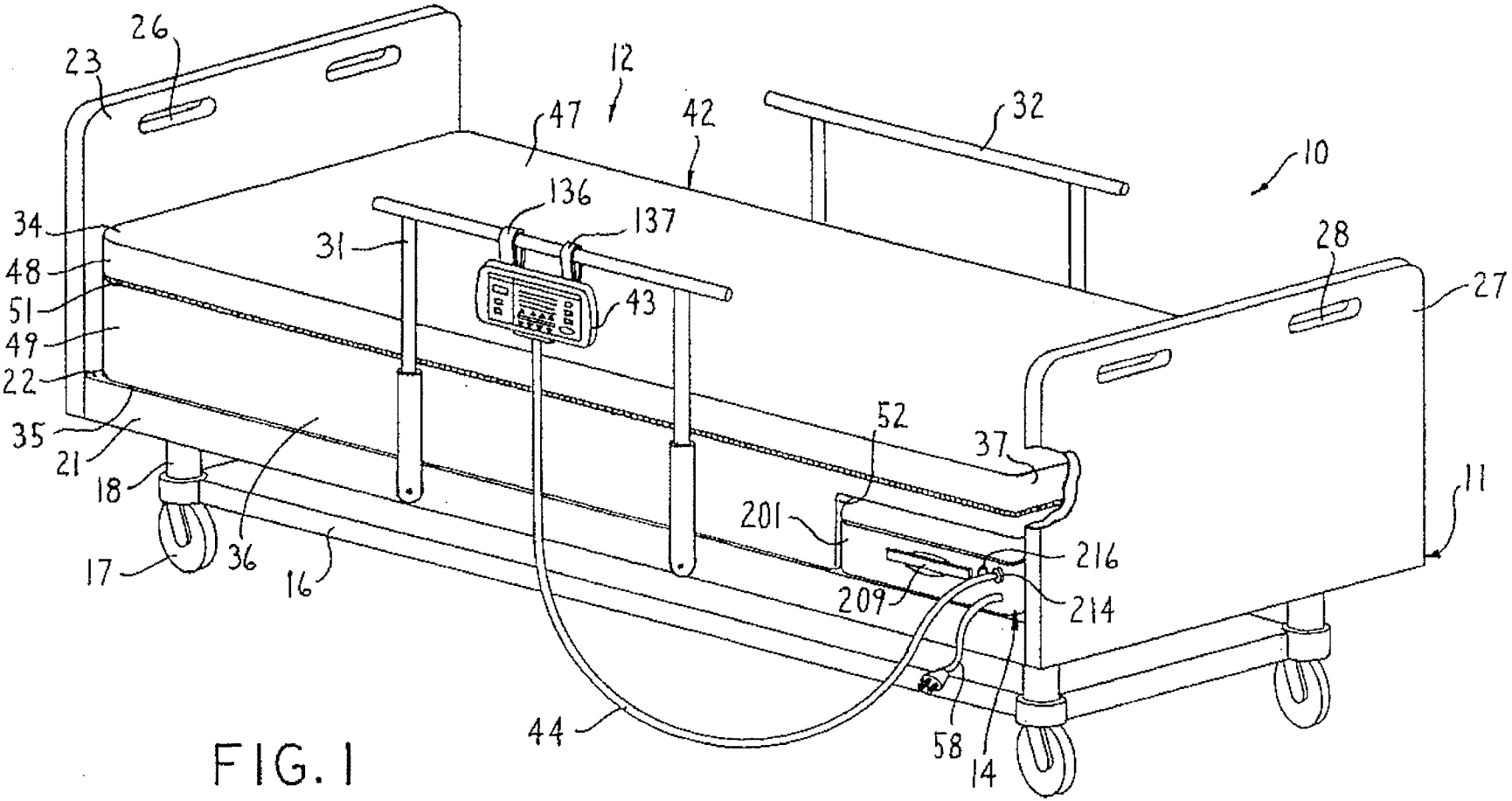
FIG. 1 is a perspective view of a mattress system which embodies the present invention, supported on a conventional hospital bed.

FIG. 1 shows an apparatus 10 which includes a conventional hospital bed 11 and a mattress system 12, the mattress system being supported on the bed and embodying the present invention.

The conventional bed 11 has a base 16 movable on four casters 17, and uprights 18 support a support section 21 on the base 16. The support section 21 has an upwardly facing surface 22. A headboard 23 is mounted at one end of the support section 21 and has near its upper end a pair of horizontal slots 26, and a footboard 27 is mounted at the opposite end of the support section 21 and has a pair of slots 28 near its upper end. Two collapsible side rails 31 and 32 are supported on opposite sides of the support section 21 for movement between the raised position shown in FIG. 1 and a lowered position. Since the bed 11 is entirely conventional, it is not described here in further detail.

The mattress system 12 has three main components, in particular a control unit 41, a mattress unit 42, and a control panel 43 which is electrically coupled to the control unit 41 by a cable 44.

The mattress unit 42 has a cover 47 with an upper portion 48 and a lower portion 49 releasably coupled to each other by a zipper 51. The cover 47 has been omitted in other figures for clarity, but it is intended that the cover 47 would be present at all times when the mattress system 12 is in operational use. The upper and lower portions 48 and 49 of the cover are preferably made of a conventional and commercially available moisture impermeable fabric.

The mattress unit 42 has an exterior surface which includes an upwardly facing top surface 34, a downwardly facing bottom surface 35, outwardly facing side surfaces on opposite sides thereof, one of which is indicated at 36, and outwardly facing end surfaces at opposite ends thereof, one of which is indicated at 37. The side surfaces are generally perpendicular to the top and bottom surfaces, and the end surfaces are generally perpendicular to the side surfaces and the top and bottom surfaces.

The mattress unit 42 has at one corner of its foot end a recess 52, which receives the control unit 41 when the mattress system 12 is configured on a bed for operational use, as shown in FIG. 1. The recess 52 opens through the bottom surface 35, the side surface 36, and the end surface 37.

Figure 2:
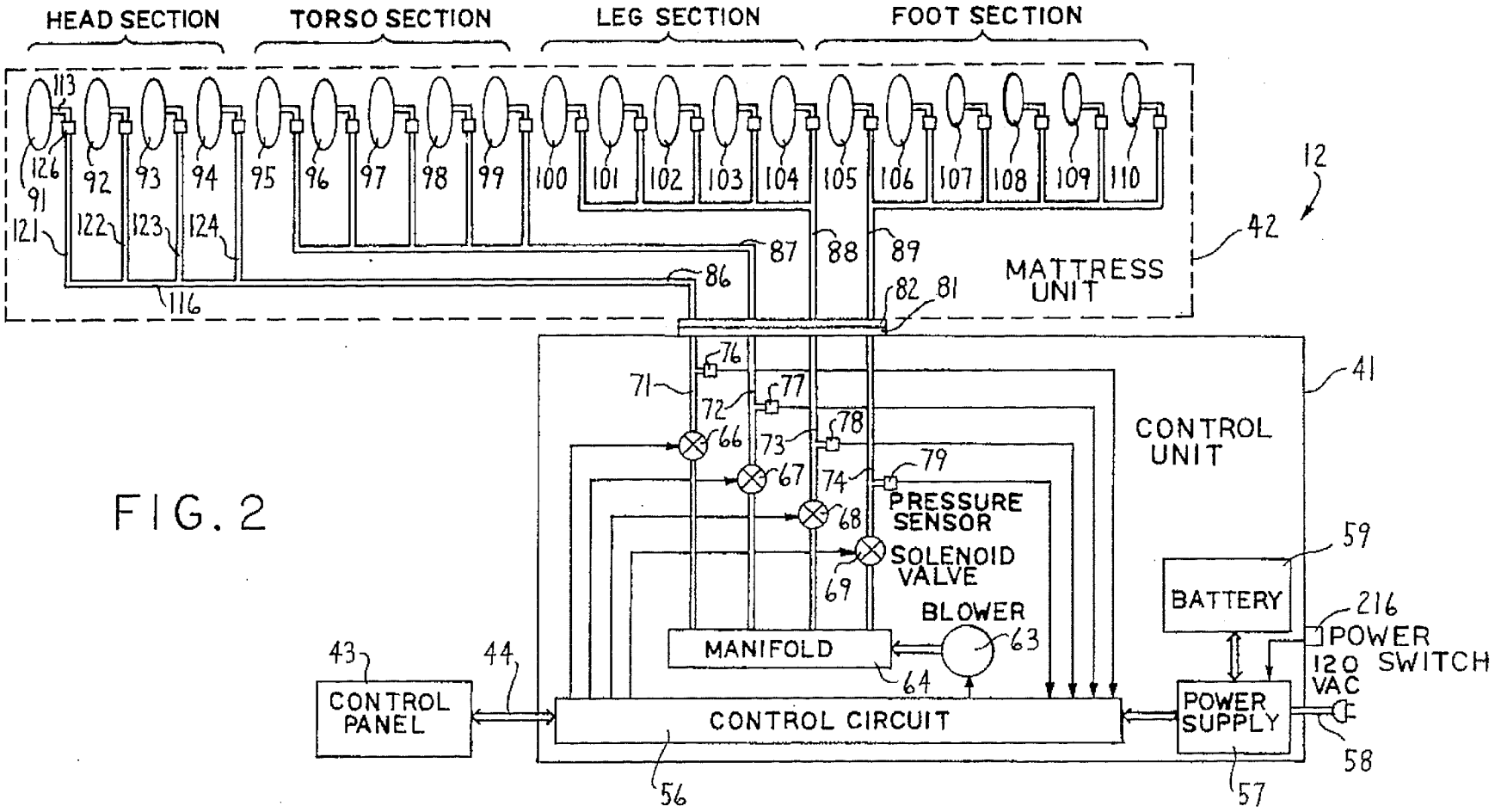
FIG. 2 is a block diagram of the mattress system of FIG. 1.

FIG. 2 is a block diagram of the mattress system 12, including the control unit 41, mattress unit 42, control panel 43, and cable 44. The internal configuration of the control unit 41 is generally conventional, and is described only briefly in order to facilitate an understanding of the present invention.

More specifically, the control unit 41 includes a microprocessor-based control circuit 56, which is coupled through cable 44 to the control panel 43. A power supply 57 supplies power to the control circuit 56, and to other internal components and the control panel 43. The power supply has a power cord 58, through which it receives standard 120 VAC power from a conventional wall outlet during normal operation. From time to time, it may be necessary to temporarily disconnect the power cord 58 from the wall outlet in order to move the bed 11, and while the bed is in transit the mattress system 12 can continue to operate without interruption using electrical power from a rechargeable battery 59 disposed in the control unit 41.

The control circuit 56 selectively controls an electrically actuated blower 63, which supplies air to a manifold 64 and which is preferably a variable speed blower. The manifold 64 can in turn supply air through respective solenoid valves 66–69 to respective conduits 71–74. The solenoid valves 66–69 are conventional components, and are independently controlled by the control circuit 56. Four pressure sensors 76–79 each communicate with a respective one of the conduits 71–74, and are each electrically coupled to the control circuit 56.

The conduits 71–74 extend to a connector part 81 which is mounted on an external surface of the control unit 41 and which can be releasably coupled to a connector part 82 on the external surface of the mattress unit 42. The connector parts 81 and 82 are conventional and commercially available parts. When the connector parts 81 and 82 are releasably coupled, the conduits 71–74 are respectively in air-tight fluid communication with respective conduits 86–89 in the mattress unit 42.

The mattress unit 42 has twenty separate inflatable bladders 91–110 along the length thereof. The bladders 91–106 are identical to each other, and the bladders 107–110 are identical to each other and are similar to the bladders 91–106, except that the bladders 107–110 have a smaller vertical height. The bladders 91–110 are arranged in four sections or zones, namely a head section or zone which includes four bladders 91–94, a torso section or zone which includes five bladders 95–99, a leg section or zone which includes five bladders 100–104, and a foot section or zone which includes six bladders 105–110. Each of the bladders includes an L-shaped tube, as indicated at 113, which communicates with the interior of the bladder and permits air to be introduced into or removed from the bladder.

Each section or zone corresponds to a respective one of the conduits 86–89. For example, the conduit 86 has an end portion 116 which splits or branches into four upright sections 121–124 each corresponding to a respective one of the bladders 91–94. The upright section 121 has at its upper end a connector 126, which releasably and airtightly couples the upright section 121 to the tube 113 for bladder 91. The upright sections 122–124 each have an identical connector at their upper ends. Likewise, the conduits 87–89 each have an end section which splits into upright sections that each end in a connector releasably coupled to the L-shaped tube of a respective one of the bladders 95–110. The conduits 86–89 normally carry respective pressures which are each associated with a respective section or zone, the bladders within each section or zone all being maintained at a common pressure associated with that section or zone.

Figure 3:
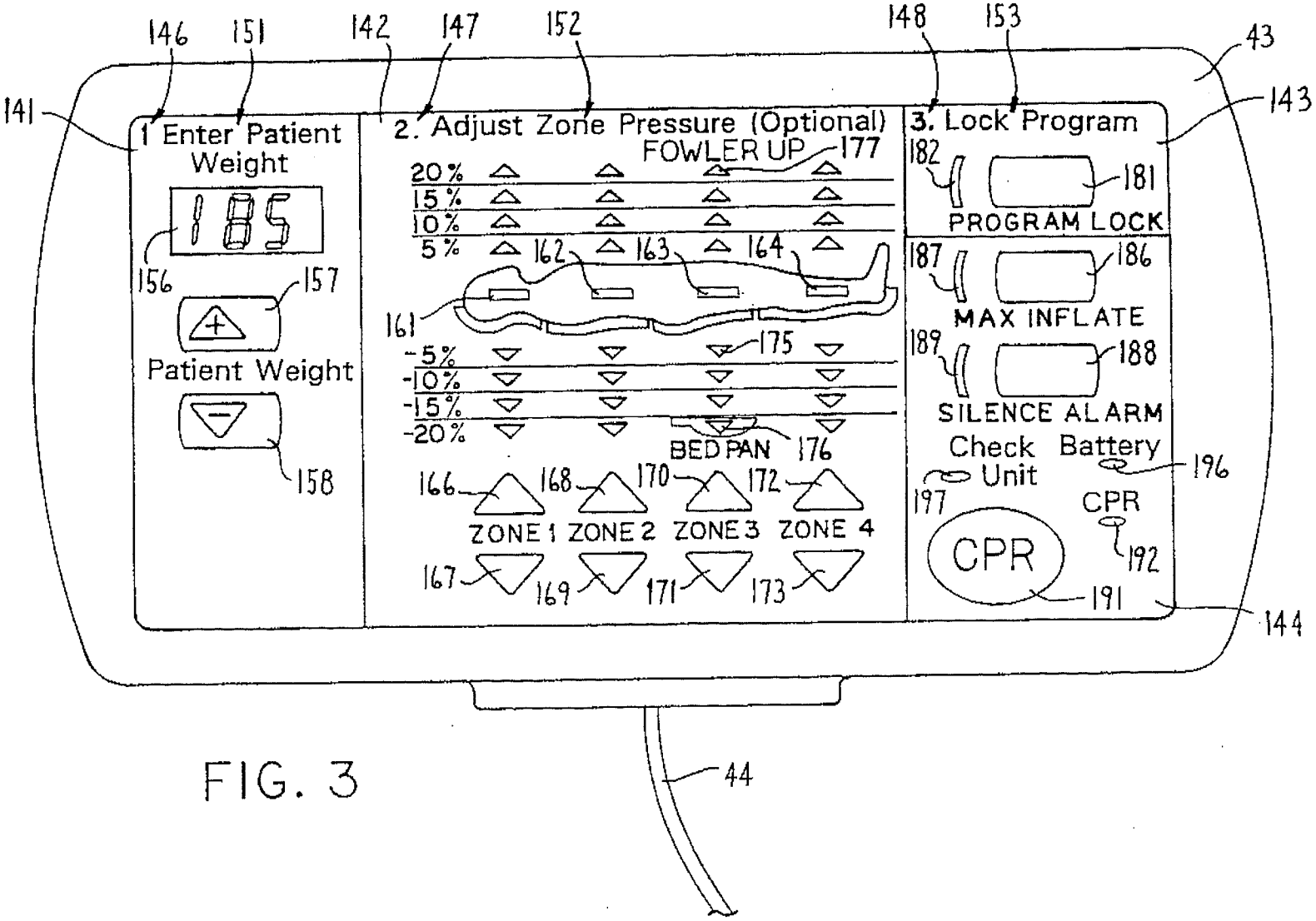
FIG. 3 is a front view of a control panel which is part of the mattress system.
Figure 4:
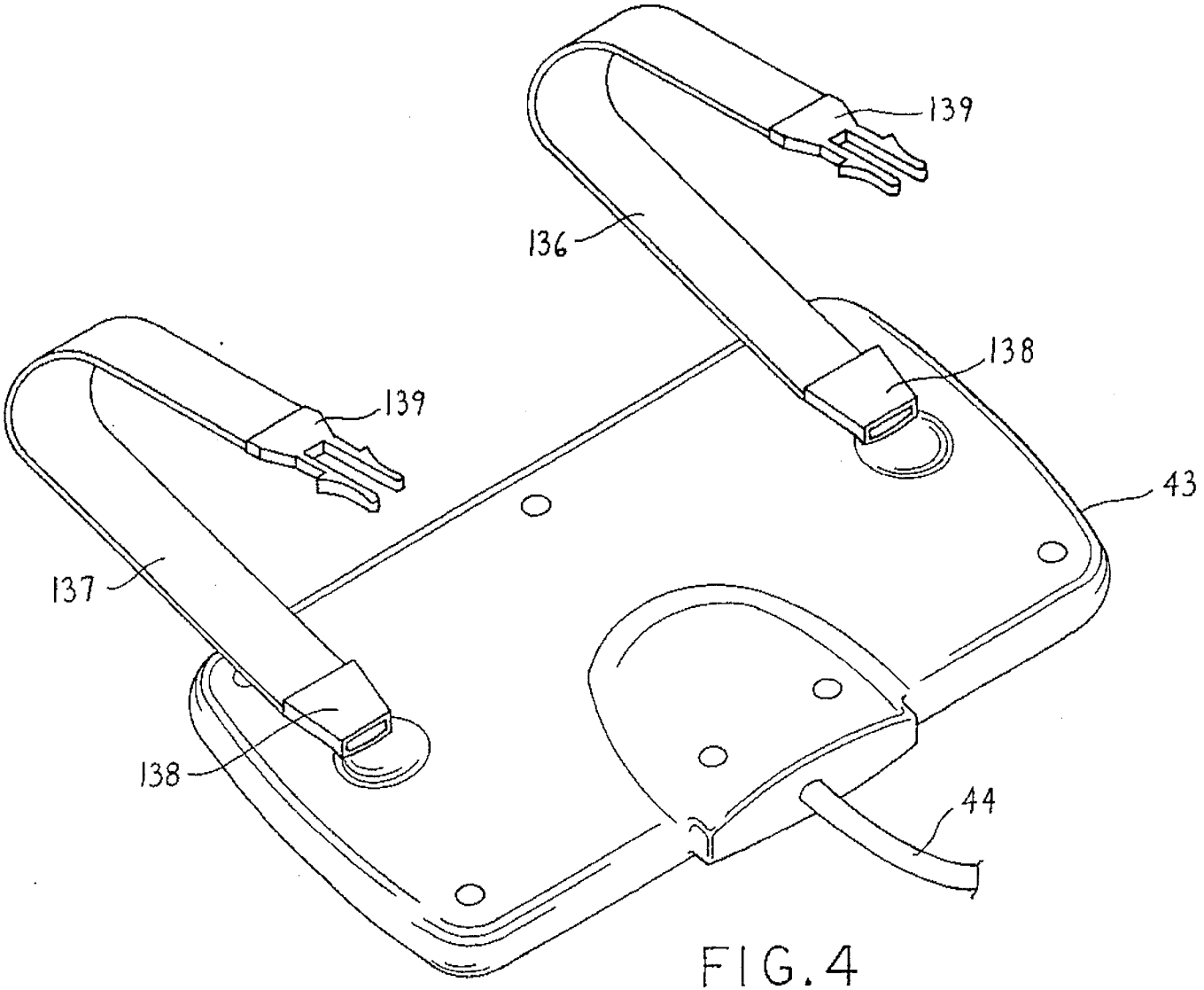
FIG. 4 is a perspective rear view of the control panel.

FIGS. 3 and 4 depict the control panel 43 in more detail. As evident from FIG. 4, the housing of the control panel 43 has a relatively flat shape, and in particular has a thickness which is substantially less than either its width or height. In the preferred embodiment, the thickness of the control panel is less than one inch, and is preferably about one-half to three-quarters of an inch. Two flexible straps 136 and 137 each have at one end a fastener part 138 which is fixedly secured to the rear of the housing 43 near a respective side edge thereof, and have at the opposite end a fastener part 139 which can releasably engage the fastener part 138 so that the strap 136 or 137 effectively forms a loop. The straps 136 and 137 can thus be used to suspend the control panel from one of the side rails of the bed as shown in FIG. 1, or from the footboard of the bed by passing the straps 136 and 137 through the slots 28.

Referring to FIG. 3, the operational portion of the control panel has four regions 141–144, the three regions 141–143 being arranged from left to right across the panel with their upper ends at the top of the operational portion. The three regions 141–143 each have indicia in the form of a respective sequence number 146–148, the sequence numbers increasing progressively from left to right. Further, the indicia in each region includes adjacent its sequence number a respective instructional label 151–153.

Region 141 includes a three-digit light emitting diode (LED) display for indicating a selected weight of a patient, and has up and down push buttons 157–158 which can be used to increase or decrease the selected weight.

Region 142 has four columns of LEDs, and each column has at its vertical center a respective rectangular LED 161–164. Above each of the rectangular LEDs 161–164 are four upwardly pointing arrowhead-shaped LEDs, one of which is identified at 177, and below each of the rectangular LEDs 161–164 are four downwardly pointing arrowhead-shaped LEDs, two of which are identified at 175 and 176. Each column of LEDs corresponds to a respective section or zone of the mattress unit. In particular, the column containing LED 161 corresponds to the head section or zone (FIG. 2), the column containing LED 162 corresponds to the torso section or zone, the column containing LED 163 corresponds to the leg section or zone, and the column containing LED 164 corresponds to the foot section or zone. Below each column of LEDs are two push buttons, one of which is an upwardly pointing arrowhead-shaped push button as at 166, 168, 170 and 172, and the other of which is a downwardly pointing arrowhead-shaped push button as at 167, 169, 171 and 173.

The third region 143 includes a PROGRAM LOCK push button 181 and an associated LED 182.

The fourth region 144 includes a MAX INFLATE push button 186 and associated LED 187, a SILENCE ALARM push button 188 and associated LED 189, and a CPR push button 191 and associated LED 192. The region 144 also includes a BATTERY LED 196 and a CHECK UNIT LED 197. The operation of the control panel is described in more detail later.

Figure 6:
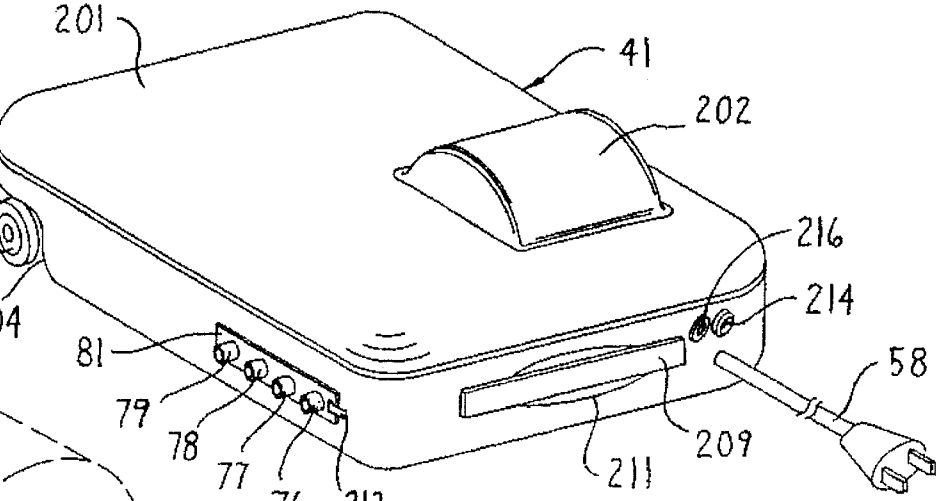
FIG. 6 is a perspective view of the control unit from a different angle.
Figure 5:
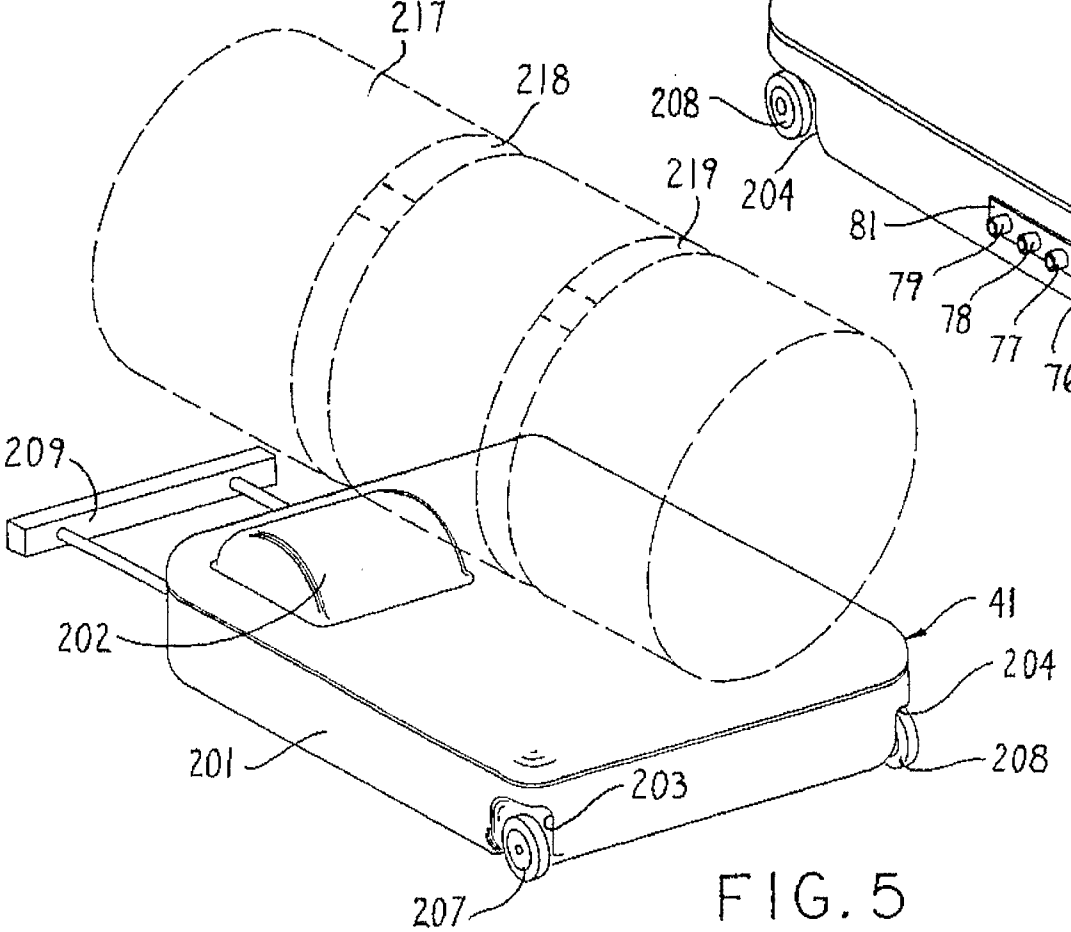
FIG. 5 is a perspective view of a control unit of the mattress system, with broken lines showing how a mattress unit of the system can optionally be mounted on the control unit for transport.

FIGS. 5 and 6 depict in more detail the exterior structure of the control unit 41. More specifically, the control unit 41 includes a housing or case 201 which is of generally rectangular shape, except that the corners are rounded to avoid sharp edges that might puncture the mattress unit or a bladder in it. The housing 201 has on its upper side a semicylindrical protrusion 202. The housing 201 contains all of the circuitry and components of the control unit which are depicted in the block diagram of FIG. 2. The smallest dimension of the blower 63 is larger than the thickness of the housing 201, and the protrusion 202 therefore permits the blower to be received within the housing 201.

The housing 201 has recesses 203 and 204 in two lower corners at an end remote from the protrusion 202, and respective wheels 207 and 208 are rotatably supported in the recesses 203 and 204, and project outwardly only a small distance beyond the bottom and end surfaces of the case 201. At the end of the case 201 remote from the wheels is a handle 209 which can move between an operational position shown in FIG. 5 and a retracted position shown in FIGS. 1 and 6. In the retracted position, the cross bar of the handle is disposed in a rectangular cavity in the case 201. A concave recess 211 is provided in the case 201 in order to permit the fingers of an operator to easily grip the handle 209 when it is in its retracted position, to thereby facilitate movement of the handle to its operational position.

With reference to FIG. 6, the connector 81 associated with conduits 76–79 is mounted on a side surface of the housing 201, and has an operating lever 213 which effects and releases the releasable connection between the connector parts 81 and 82 (FIG. 2). The power cord 58 extends out of the housing 201 through the end surface associated with handle 209, and nearby is a connector or jack 214 to which the cable 44 (FIG. 1) for the control panel can be connected. Adjacent the connector or jack 214 is a power switch 216 which can be manually operated to turn power to the system circuitry on and off.

FIG. 5 shows in broken lines an approximately cylindrical bag or case 217, which can receive the mattress unit 42 when the mattress unit 42 is disconnected from the control unit 41 and is in its deflated or collapsed condition. Two straps 218 and 219 are secured to the exterior surface of housing 201 and can removably hold the bag 217 in the position shown in FIG. 5. The bag 217 is preferably stitched to the underside of the cover 47 (FIG. 1) of the mattress unit, or to one or both of the straps 218 and 219, so that it cannot be inadvertently lost. The control panel and its cable may be placed within the bag 217. It will be recognized that the entire mattress system can thus be easily transported by simply holding the handle 209 with one hand and pulling so that the wheels 207 and 208 roll along a floor surface. Alternatively, it will be recognized that the housing 201 could be formed to have a separate pocket to hold the control panel.

Figure 7:
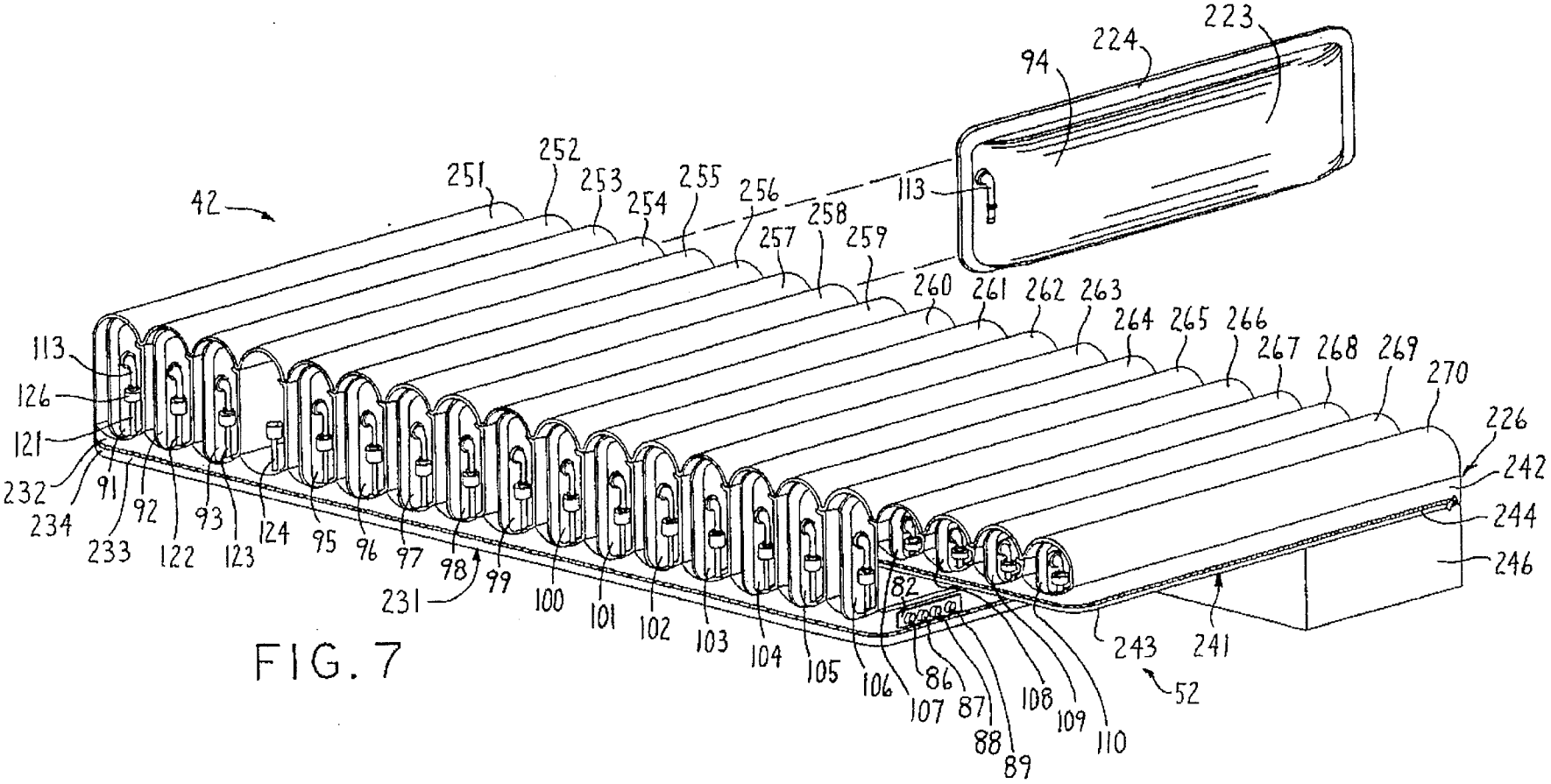
FIG. 7 is a perspective view of the mattress unit with a cover removed for clarity.

Referring to FIG. 7, the bladder 94 can be seen in more detail. The bladder 94 includes two sheets of gas impermeable fabric which are of generally rectangular shape, except for rounded corners, one of the sheets being visible at 223. The sheets are disposed adjacent and in alignment with each other, and are sealingly secured to each other all around their peripheral edges by a seam 224. The L-shaped tube 113 projects outwardly and then downwardly from the sheet 223 adjacent one end thereof.

Figure 8:
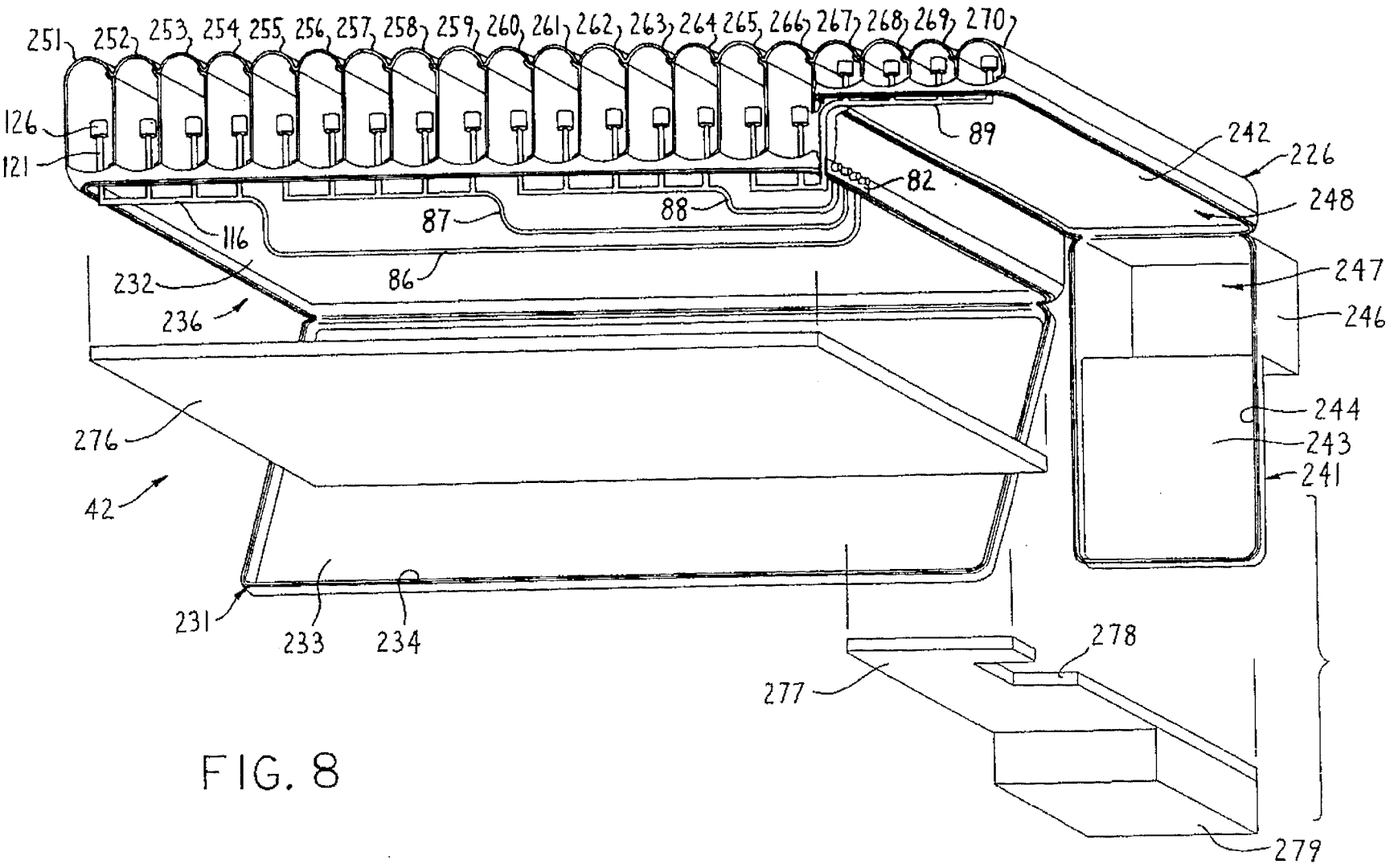
FIG. 8 is an exploded perspective view of the mattress unit, with air bladders and the cover omitted for clarity.

Referring to FIGS. 7 and 8, the mattress unit 42 includes a containment jacket 226, which is preferably made substantially from a synthetic fabric such as nylon. It has a main base section 231 having approximately horizontal and rectangular upper and lower sheets 232 and 233, which can be releasably secured to each other along their peripheral edges by a zipper 234, so as to define a shallow main pocket 236 of approximately rectangular shape. An auxiliary base section 241 has approximately horizontal and rectangular upper and lower sheets 242 and 243, which can be releasably secured to each other along their peripheral edges by a zipper 244. The lower sheet 243 has at one end a rectangular opening, and an additional fabric portion 246 defines a generally rectangular cavity 247 which opens downwardly from and communicates with a shallow and approximately rectangular pocket 248 between the sheets 242 and 243. A strip 249 of fabric extends vertically from one end of main base section 231 to the adjacent end of auxiliary base section 241.

The containment jacket 226 also includes twenty adjacent containment sleeves which each have an oval-shaped cross section and which are parallel to each other and extend transversely of the containment jacket from one side thereof to the other side thereof. Each of the sleeves 251–270 is open at each end. Each sleeve necessarily has a transverse oval-shaped opening through it. The sixteen sleeves 251–266 are disposed above the main base section 231, and the four sleeves 267–270 are disposed above the auxiliary base section 241. The four sleeves 267–270 and the openings through them have a vertical height which is about half the vertical height of the sleeves 251–266 and the openings through them.

As best seen in FIG. 8, the connector 82 is mounted on an end of the main base section 231, just above zipper 234 and just below fabric strip 249. The routes of the conduits 86–89 are shown somewhat diagrammatically in FIG. 8 for clarity. Each conduit essentially extends approximately straight from the connector 82 within the main pocket 236 along one side of the main pocket. A portion of conduit 89 also extends upwardly behind fabric strip 249 to the auxiliary pocket 248, and extends within the auxiliary pocket at an end thereof remote from the cavity 247. Each of the upright conduit sections, such as that shown at 121, extend upwardly through a small opening in one of the upper sheets 232 or 242, and into a respective one of the containment sleeves 251–270.

A flat main foam sheet 276 of generally rectangular shape is disposed in the main pocket 236, the sheet 276 having a length substantially equal to the length of the pocket 236, and having a width slightly less than the width of the pocket in order to allow room for the conduits 86–89 to extend along an edge of the pocket. A flat auxiliary foam sheet 277 of rectangular shape is disposed in the auxiliary pocket 248, and a rectangular foam block 279 is secured to the underside of one end of the sheet 277 and effectively fills the cavity 247. The foam sheet 277 has a square cutout 278 in an edge below the containment sleeve 270 and near the end of sheet 277 remote from block 279.

OPERATION

In a non-operational configuration, the mattress unit 42 is disposed within the bag or case 217 secured by the straps 218 and 219 to the housing 201 of control unit 41, as shown in FIG. 5. The apparatus 10 is transported in this configuration to a bed on which it is to be used by manually grasping and pulling on handle 209 with the case 201 at an incline, so that the wheels 207 and 208 roll along a floor surface. Upon reaching the bed, the collapsed mattress unit 42 is removed from the bag 217.

The control unit 41 is then placed on the upwardly facing surface 22 of the bed to one side of the foot end thereof, in the orientation shown in FIG. 1. The mattress 42, still in its deflated condition, is then placed on the upwardly facing surface 22 of the bed so that the control unit 41 is received within the recess 52. The fabric sheet 243 flexes to allow the protrusion 202 (FIG. 6) on the control unit 41 to extend into the cutout 278 (FIG. 8), so that the foam sheet 277 extends substantially flat above the control unit 41.

The operating lever 213 (FIG. 6) is then used to operatively couple the connectors 81 and 82 to each other. The straps 136 and 137 are used to suspend the control panel 43 from one of the side rails 31 or 32, or from the footboard 27 of the bed, and the cable for the control panel 43 is connected to the connector or jack 214 on the control unit 41. The power cord 58 is then plugged into a standard 120 VAC wall outlet (unless the unit is to be operated on battery power). The power switch 216 is then operated to supply power to the circuitry of control unit 41 and control panel 43.

To initialize the unit, and referring to FIG. 3, an operator carries out the instructions 151–153 in the order indicated by indicia 146–148 or in other words left to right. In particular, the operator first uses buttons 157 and 158 to adjust the selected patient weight displayed at 156 to the actual weight of the patient who is to use the bed. Based on the selected weight, the unit automatically determines an appropriate respective pressure for each zone, and lights each of the LEDs 161–164. These default pressures derived from the selected patient weight are not necessarily equal to each other, even though the LEDs 161–164 are at the same vertical level on the control panel.

If the operator considers the default pressure distribution satisfactory, no adjustments are needed in the region 142, which is why instructional indicia 152 indicates that it is "optional". However, if the operator determines that it is necessary to deviate from the default pressure distribution in one or more zones, the pressure for each zone can be adjusted upwardly or downwardly in increments of 5%, up to a total of 20%. For example, if button 166 is pressed, the LED 161 will be turned off and the arrowhead-shaped LED immediately above it will be turned on, and the pressure setpoint associated with that zone will be increased by 5%. If the button 166 is pressed again, the pressure setpoint for that zone will be increased by another 5% and the illuminated arrowhead-shaped LED will be turned off and the arrowhead-shaped LED immediately above it will be turned on. Thus, the buttons 166, 168, 170 and 172 can be pressed to increase the pressure for respective zones by 5% increments, and the buttons 167, 169, 171 and 173 can be pressed to decrease the pressure setpoints for respective zones by 5% decrements.

With respect to Zone 3, which is the leg section or zone, the button 171 can be pressed until the LED 176 is lit in order to indicate the pressure setpoint is 20% below the default value, the decreased pressure in this zone facilitating insertion of a bedpan between the patient and mattress. Alternatively, the button 170 for that zone can be pressed until LED 177 is lit in order to indicate that the pressure setpoint for that zone is 20% above the default value, so that when a bed with a movable back support (commonly known as a fowler) is adjusted to change the patient to a sitting position, that zone will have extra pressure in order to better support a portion of the weight from the head and torso of the patient which is directed downwardly onto the leg section (Zone 3).

After making adjustments, if any, in region 142, the operator moves to region 143 according to sequencing indicia 148, and presses the PROGRAM LOCK button 181 in region 143, in response to which the control unit lights LED 182 and ignores all buttons on the control panel other than button 181, until button 181 is pressed again to disable the program lock feature. The program lock feature ensures that the settings on the control panel are not changed as a result of an attendant inadvertently bumping against the control panel or as a result of a curious child tinkering with the control panel. Once the operator has pressed button 181 to actuate the program lock feature, the set up of the system is completed.

Region 144 of the control panel includes buttons and lights which provide status information and/or which implement special functions. In particular, if the MAX INFLATE button 186 is pressed, each of the sections or zones of the mattress is promptly inflated to its maximum pressure, and the LED 187 is turned on to indicate that maximum inflation is in effect. The maximum inflate button 186 can be pressed again to disable the maximum inflate feature and turn off LED 187, after which the control unit 41 returns to normal operation at the setpoints determined by regions 141 and 142.

If one of the bladders develops an air leak, the blower 63 (FIG. 2) will need to run proportionately longer and/or more often in order to maintain the zone containing that bladder at the desired pressure.

If the system determines that the blower is being operated more than should be necessary in order to maintain the selected pressure, one of the bladders probably has a leak, and the system produces an audible alarm sound to notify the operator that one of the bladders may have a leak requiring attention. The SILENCE ALARM button 188 can be pressed to prevent generation of the audible alarm, until such time as the silence alarm button 188 is pressed again. The LED 189 is turned on when the silence alarm feature is actuated, and is turned off when the feature is disabled.

A cardiopulmonary resuscitation (CPR) button 191 can be pressed to cause the control unit 41 to immediately deflate all of the bladders 91–110. With reference to FIG. 2, this can be effected by opening each of the four valves 66–69, and by reversing the direction of the blower 63 so that the blower 63 sucks air out of the bladders. When the CPR 191 button is pressed again, the CPR feature is deactuated and the control unit returns to normal operation maintaining in the various zones the user-entered pressure specified by regions 141 and 142. A CPR LED 192 is turned on when the CPR feature is actuated, and is turned off when it is deactuated.

If the system is running on battery power, and if the battery is approaching a level of discharge at which it will not have sufficient energy to operate the system, the BATTERY LED 196 is turned on to indicate that the charge level of the battery is reaching a point where the power cord 58 needs to be connected to an AC source in order to continue operation of the system while recharging the battery. The CHECK UNIT LED 197 is turned on if the control unit detects any type of problem, such as a possible air leak from the one of the bladders.

Although a particular preferred embodiment of the invention has been illustrated and described in detail for illustrative purposes, it will be recognized that variations or modifications of the disclosed apparatus, including the rearrangement of parts, lie within the scope of the invention defined by the claims.

The embodiments of the invention in which an exclusive property or privilege is claimed are defined as follows:

1. A portable patient support system comprising: a mattress unit having therein inflatable bladder means and having operational and collapsed states in which said bladder means is respectively inflated and deflated, wherein said mattress has an exterior surface which includes an upwardly facing top surface portion in said operational state, has at one end a foot section, has in said foot section a portion of said bladder means and has means defining in said foot section below said portion of said bladder means a recess which opens through said exterior surface of said mattress unit; a control unit having a size and shape permitting it to be removably received in its entirety within said recess; and means operatively coupling said control unit to said bladder means within said mattress unit to facilitate control by said control unit of a pressure within said bladder means.

2. A system according to claim 1, wherein said control unit and said recess are substantially identical in size and shape.

3. A system according to claim 2, wherein said control unit and said recess are each generally rectangular; wherein said recess opens through a bottom surface portion, an end surface portion, and a side surface portion of said exterior surface; and wherein said control unit has a bottom surface portion, a side surface portion and an end surface portion thereon which, when said control unit is in said recess, are respectively substantially flush with said bottom surface portion, said side surface portion and said end surface portion of said exterior surface of said mattress unit.

4. A system according to claim 1, wherein said means for operatively coupling includes means for effecting a releasable coupling between said control unit and said mattress unit.

5. A system according to claim 4, wherein said bladder means includes a plurality of separate zones which are free of fluid intercommunication, wherein said mattress unit includes a plurality of conduits which are equal in number to and which each communicate with a respective one of said zones in said bladder means, wherein said control unit includes a plurality of second conduits which are equal in number to said first conduits, and wherein said means for releasably coupling effects only fluid communication between each of said first conduits and a respective one of said second conduits.

6. A system according to claim 1, wherein said bladder means has a further portion in a section of said mattress unit other than said foot section, said portion of said bladder means in said further section having a greater vertical height than said portion thereof in said foot section.

7. A system according to claim 1, wherein said recess opens through a bottom surface portion and a side surface portion of said mattress unit.

8. A system according to claim 7, wherein said control unit has a side surface facing in the same direction as said side surface portion of said mattress unit through which said recess opens, including a control panel having means for facilitating manual control of said control unit by an operator, including a cable extending from said control panel to said control unit and entering said control unit through said side surface thereof, and including a power cord which enters said control unit through said side surface thereof.

9. A system according to claim 1, wherein said control unit has thereon a handle and rotatably supported wheels, and including means for supporting said mattress unit on said control unit when said mattress unit is in said collapsed state.

10. A system according to claim 1, including power supply means for supplying electrical power to said control unit, said power supply means including a rechargeable battery within said control unit, a power cord extending from a location inside said control unit to a location outside said control unit, and a power supply circuit operatively coupled to said power cord and said battery.

11. A portable patient support system, comprising: a mattress unit having inflatable bladder means therein, and having operational and collapsed states in which said bladder means is respectively inflated and deflated, wherein in said operational state said mattress unit has a downwardly facing bottom surface, said mattress unit having at one end thereof a foot section, and having means defining in said foot section a recess which opens through said bottom surface; a control unit having a size and shape permitting it to be received in its entirety within said recess, said control unit having means for facilitating transport thereof in a non-operational state thereof, said means for facilitating transport including wheels rotatably supported on said control unit; and means for operatively coupling said control unit to said bladder means within said mattress unit to facilitate control by said control unit of a pressure within said bladder means.

12. A system according to claim 11, wherein said control unit has a manually graspable handle thereon.

13. A system according to claim 12, wherein said handle is supported on said control unit for movement between an operational position and a retracted position.

14. A system according to claim 12, including means for supporting said mattress unit on said control unit when said mattress unit is in said collapsed state.

15. A system according to claim 11, wherein said means for operatively coupling includes means for effecting a detectable coupling of said control unit to said mattress unit.

16. An apparatus, comprising: a mattress unit having an external cover made of flexible material, a containment part provided within said cover, said containment part having therein a plurality of transverse horizontal first-mentioned openings, a pocket containing foam material located below said first-mentioned openings, said containment part further having at a foot end thereof a plurality of further openings which extend horizontally and transversely, which have a lesser vertical height than said first-mentioned openings and which each have removably disposed therein an elongate bladder, and including below said further openings a further pocket having further foam therein.

17. An apparatus according to claim 16, including a control unit, and wherein said mattress has means defining in an underside thereof below said further foam a recess having a size and shape permitting said control unit to be received in its entirety within said recess, and means for operatively coupling said control unit to each of said bladders within said mattress unit.

18. An apparatus according to claim 17, wherein said means for coupling includes releasable coupling means for releasably coupling said control unit to said mattress unit, said releasable coupling means including a first coupling part provided on said mattress unit within said recess and a second coupling part provided on said control unit and releasably engageable with said first coupling part.

19. An apparatus according to claim 17, wherein said containment part has first and second separate zippers which each provide access to a respective one of said pockets.

20. A mattress system, comprising: an inflatable bladder, a control unit which is operationally coupled to said inflatable bladder and which controls a pressure in said inflatable bladder as a function of a plurality of control parameters, and a control panel which is physically separate from and operationally coupled to said control unit and which facilitates manual setting of said control parameters, said control panel being a self-contained unit of flat and thin shape having manually operable keys on one side thereof, and having two straps secured to a housing of said control panel at spaced locations thereon, and fastening means for releasably coupling one end of each said strap to an opposite end thereof.

* * * * *